US007255045B2

(12) United States Patent
Owens

(10) Patent No.: US 7,255,045 B2
(45) **Date of Patent: *Aug. 14, 2007**

(54) MULTI-PROGRAM TROLLEYS AND SWITCHES

(75) Inventor: N. Douglas Owens, Lynn, IN (US)

(73) Assignee: Modernfold, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 11/263,471

(22) Filed: Oct. 31, 2005

(65) Prior Publication Data

US 2006/0096494 A1 May 11, 2006

Related U.S. Application Data

(63) Continuation of application No. 10/601,490, filed on Jun. 23, 2003.

(60) Provisional application No. 60/391,791, filed on Jun. 26, 2002.

(51) Int. Cl.
*B61B 3/00* (2006.01)

(52) U.S. Cl. ..... 104/89; 105/148

(58) Field of Classification Search ..... 104/89, 104/90, 91, 93; 105/148, 149, 149.1, 150
See application file for complete search history.

(56) References Cited

U.S. PATENT DOCUMENTS

| | | | |
|---|---|---|---|
| 2,944,282 | A | 7/1960 | Greco |
| 3,253,552 | A | 5/1966 | Stein |
| 3,334,375 | A | 8/1967 | Hubbard |
| 4,555,828 | A | 12/1985 | Matimura |
| 4,569,164 | A | 2/1986 | Dickson |
| 4,752,987 | A | 6/1988 | Dreyer et al. |
| 4,919,053 | A | 4/1990 | Redondo |
| 5,016,318 | A | 5/1991 | Harris |
| 5,090,171 | A | 2/1992 | Kano et al. |
| 5,357,651 | A | 10/1994 | Jones et al. |
| 6,220,173 | B1 | 4/2001 | Sauerwein |
| 6,286,258 | B1 | 9/2001 | Bischof et al. |
| 6,619,468 | B1 | 9/2003 | Baneck et al. |

FOREIGN PATENT DOCUMENTS

| | | |
|---|---|---|
| EP | 0 408 006 B1 | 9/1995 |
| GB | 0 408 006 B1 | 9/1995 |

*Primary Examiner*—S. Joseph Morano
*Assistant Examiner*—Robert J. McCarry, Jr.
(74) *Attorney, Agent, or Firm*—Baker & Daniels LLP

(57) ABSTRACT

A multi-program trolley and track switch system is provided for a movable wall system having multiple panels supported and movable along multiple paths defined by multiple track sections. Switch assemblies automatically direct each wall panel to a predetermined wall forming location based on the arrangement of guide plates in the each switch assembly and the configuration of a diverter element associated with each trolley. Each switch assembly includes an array of vertically oriented guide plates offset at different lateral distances from the track path. Each trolley includes a side diverter element that is positioned a predetermined lateral distance from the trolley centerline to engage a pre-selected switch guide plate. In one embodiment, lead trolleys have only a side diverter element while trailing trolleys have both a side diverter element and a center diverter element.

12 Claims, 13 Drawing Sheets

MULTI-PROGRAM TROLLEYS AND SWITCHES

This application is a continuation of pending U.S. Utility Application Ser. No. 10/601,490, filed Jun. 23, 2003, entitled "MULTI-PROGRAM TROLLEYS AND SWITCHES" which claimed priority from U.S. Provisional Application No. 60/391,791, filed Jun. 26, 2002, entitled "MULTI-PROGRAM TROLLEYS AND SWITCHES."

BACKGROUND OF THE INVENTION

1. Field of the Invention

The present invention relates to operable wall systems used to partition larger rooms into smaller rooms and particularly to a track and trolley system wherein the trolleys can be programmed to automatically switch panels to form a desired room layout.

2. Description of the Related Art

Operable wall panel systems, also known as movable wall panel systems, are often used to temporarily subdivide large rooms into smaller rooms such as in convention halls, hotels, and the like. These systems typically include an overhead track and trolley suspension system whereby wall panels are moved along the track from a storage area to a wall forming position in the space being subdivided. The track may include a number of switches where turns and/or intersections are provided for moving the wall panels.

One difficulty in subdividing an area arises when several wall panels must be moved from a storage area through multiple intersecting track segments to a specific location to form a desired room arrangement. In many instances, each individual panel has a pre-designated position in the final room layout. This is particularly important where the subdivided room arrangement has rooms where the walls are of different colors or differing surface textures which may require some of the panels to have differing features on opposite sides. In these situations, improper placement of the panels could result in mismatches in the final room layout. Previously, the process of subdividing a large space was quite time-consuming requiring that panel placement be closely monitored to achieve the desired result.

In order to facilitate the process of directing panels to a pre-determined position, guide plates have been mounted on the track intersections and used to cooperate with diverter elements mounted on the panel trolleys. In operation, the guide plates on the track intersection engage the diverter elements on the wall panel trolleys to direct the wall panel on to the proper track. One such prior design is described in U.S. patent application Ser. No. 09/706,041 filed Nov. 3, 2000 and which is assigned to the assignee of the present invention.

In some designs, trolleys have been equipped with diverter elements that extend above the trolley wheels to engage a diverter plate mounted on the under side of a top plate of the track switch in combination with additional diverter elements mounted to a plate laterally extending from the trolley below the wheels, that engage diverter plates mounted to the underside of the bottom plate of the track switch.

One shortcoming in these prior designs is in the number of trolley and track switch combinations required to subdivide a large area.

In another type of movable wall system, electric switching stations are used to direct or switch wall panels to their appropriate track. The switching station includes a rotatable platter mounted at the intersection of multiple tracks. The platter is electrically operated to rotate between multiple positions connecting different track sections together at each position. One disadvantage of this system is that although it allows numerous track sections to be selectively interconnected to move the wall panels down their proper paths, a person is required to control the movement of the platter. The electric switching systems are also relatively expensive.

What is needed is a programmable trolley and track system that automatically directs individual wall panels to a pre-determined position in a layout without an excessive number of switch and trolley designs.

SUMMARY OF THE INVENTION

The present invention provides a multi programmed track switch and trolley system that automatically routes wall panels between intersecting tracks to a pre-determined or pre-programmed wall-forming position. The track switch section includes selectively positioned guide plates on the upper interior wall of the track switch section. The guide plates engage diverter elements positioned on the trolley to direct wall panels on a particular path through the switch section. Each trolley includes an elongated diverter element or blade laterally displaced from the trolley centerline. The lateral displacement of the diverter blades is variable so as to engage selected guide plates on the track switch sections. The diverter blades are also variable in height to engage or not engage certain guide plates.

In addition, the trailing trolleys also include one or more centrally mounted diverter pins which are also variable both in height and lateral displacement relative to the trolley centerline. Through the selection of diverter blade and diverter pin arrangements, trolleys can be paired forming multiple combinations from a set of basic trolley designs.

The present invention accomplishes a primary objective of providing a track switch and trolley system that automatically routes individual wall panels of an operable wall system to a pre-determined wall forming location to compartmentalize a large room into smaller rooms without the need for an excessive number of individual trolley and switch designs.

The invention accomplishes a further objective of providing a switching system that is automatic, and without the need for human intervention.

The invention accomplishes a still further objective of providing a switching system wherein a basic set of trolley and track switch designs can be combined to form a variety of room layouts.

The invention accomplishes still another objective of providing a cost effective switching system not requiring electrical power.

The invention accomplishes a still further objective of providing a switching system that permits all of the wall panels to be stored in one track storage section without the need for offset switches or flapper panels.

BRIEF DESCRIPTION OF THE DRAWINGS

The above mentioned and other advantages and objects of this invention, and the manner of obtaining them, will become more apparent and the invention itself will be better understood by reference to the following descriptions of embodiments of the invention taken in conjunction with the accompanying drawings, wherein.

Figure 1:
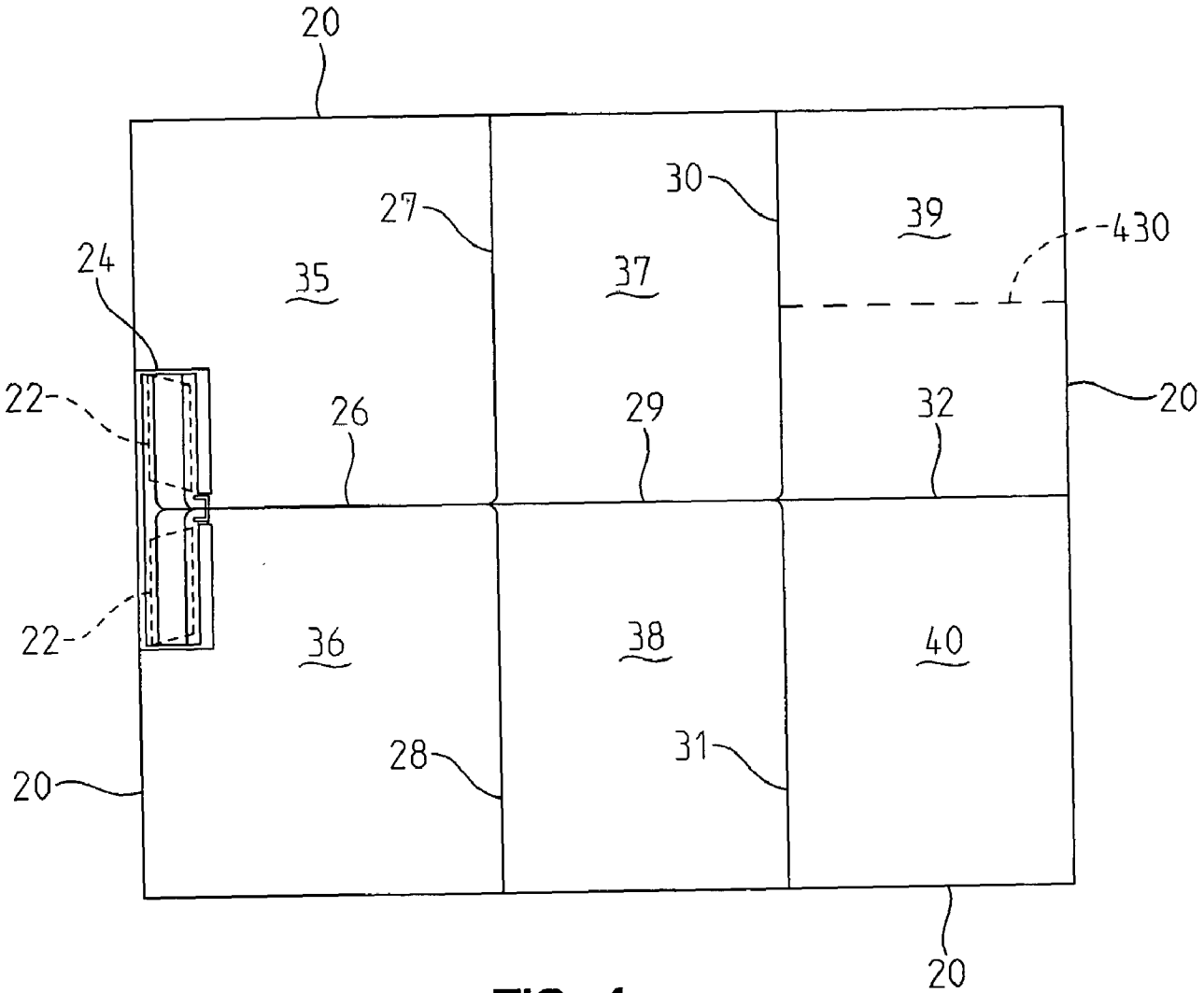
FIG. 1 is a diagrammatic top view of an operable wall system using a trolley and track switching system according to the present invention.

Corresponding reference characters indicate corresponding parts throughout the several views. Although the drawings represent embodiments of the invention, the drawings are not necessarily to scale and certain features may be exaggerated or omitted in order to better illustrate and explain the present invention.

DESCRIPTION OF THE INVENTION

For the purposes of promoting an understanding of the principles of the invention, reference will now be made to the embodiments illustrated in the drawings and specific language will be used to describe the same. It will nevertheless be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
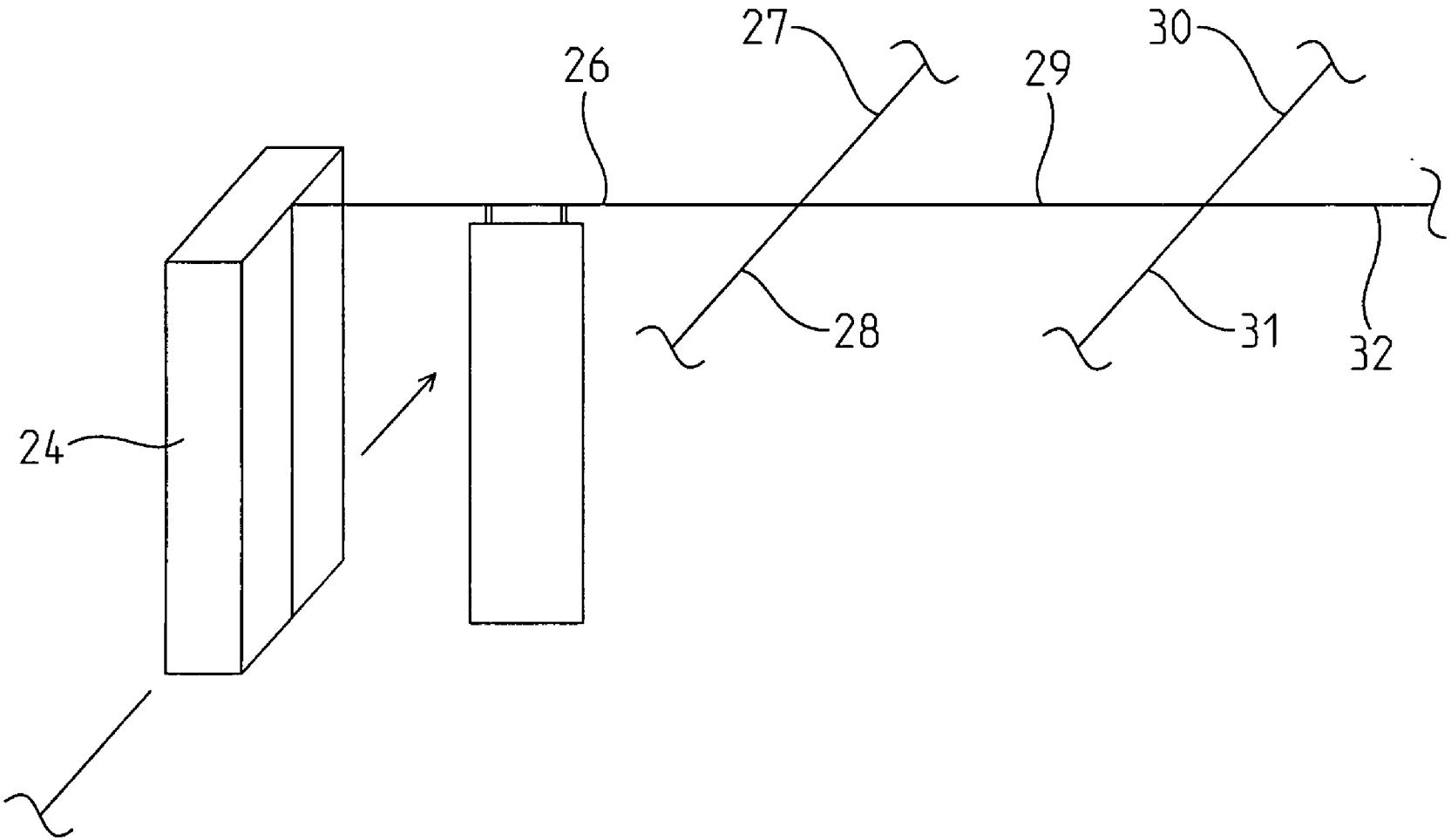
FIG. 2 is a diagrammatic perspective view of the operable wall system of FIG. 1.

Referring now to FIGS. 1 and 2, there is diagrammatically shown a top view and a perspective view of a movable wall panel system including an automatic track switching system of the present invention. The movable wall panel system serves to selectively compartmentalize a single, large room 20 into smaller rooms or areas. The operable wall includes a multitude of panels that extend from the floor to the ceiling of room 20, which panels are shown in FIG. 1 in dashed lines at 22 in a stacked or storage position within a housing abstractly indicated at 24. In FIG. 2, one of the panels 22 is shown being moved to a wall-forming location. Although shown as being within room 20, housing 24 typically is located directly adjacent to and outward of a side wall of room 20 as a specially designed pocket room. Wall panels 22 may be of any conventional construction. None of the panels 22 are hinged to adjacent panels in the inventive panel system, as the track switching system of the present invention uses panels that are each separately movable along the track between an operational, wall-forming position and a storage position.

Panels 22 are movable along track segments mounted in the ceiling which form intersecting track sections 26, 27, 28, 29, 30, 31 and 32. Track sections 26–32 are designed such that when panels 22 are all in their wall-forming positions, room 20 is compartmentalized into six smaller rooms or areas 35, 36, 37, 38, 39 and 40. This track configuration is merely illustrative and not intended to be limiting as the inventive track switching system may be employed with more complicated or less complicated tracks, including intersecting tracks that serve to compartmentalize a room into different numbers of smaller room or differently shaped rooms. In addition, the shown track configuration can be used in an even larger room than room 20, which larger room is equipped with one or more additional operable wall panel systems that are similar to the shown system and which form walls in alignment with the walls formed by the shown wall panel system to provide suitable room compartmentalization.

Figure 3:
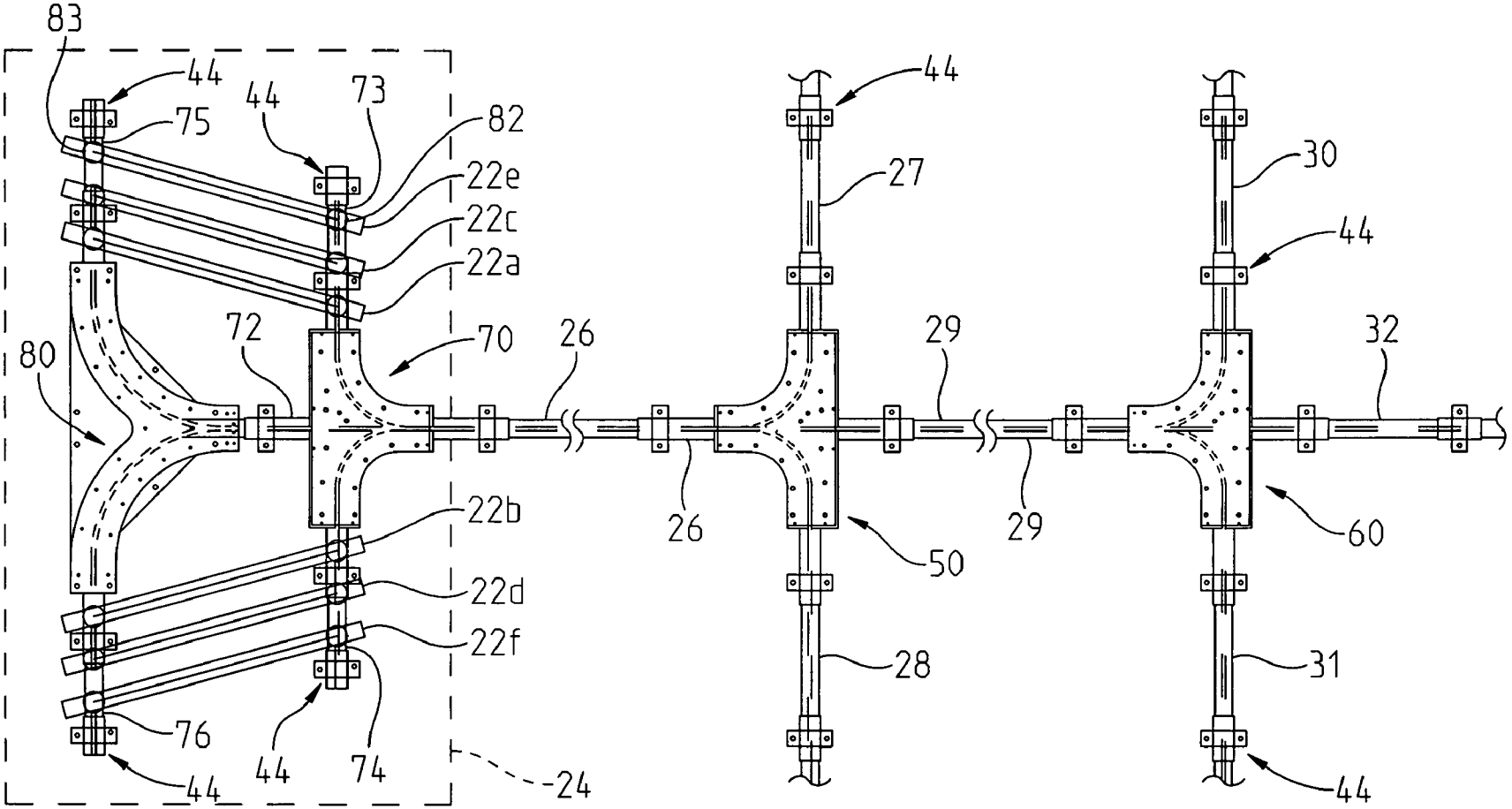
FIG. 3 is a partial diagrammatic top view of the operable wall system of FIG. 1 wherein the track and track switch sections are shown in additional detail.

Referring now to FIG. 3, portions of the operable wall of FIG. 1 are shown in a top view. Track sections 26–32 are of a conventional design suitable for use with the type of trolley employed with the panels. As described below, different types of trolleys may be used within the scope of the invention, and the track construction will be changed in a corresponding fashion to provide proper a suitable track and trolley combination. In the illustrated embodiment, track sections 26–32 are made of steel beams which are generally square in vertical cross-section. The wheels of the trolley ride along the bottom wall of the track section, and a slot centered in that bottom wall which extends longitudinally along the track section length permits passage of the pendant trolley bolt that attaches to the top of a panel 22. Track sections 26–32 are mounted to the ceiling support structure by means of hanger brackets of conventional design, generally shown at 44, positioned at spaced intervals along the lengths of the track sections.

A switch assembly, generally designated 50, serves as an intersecting track section for track sections 26–29 and is operably connected to each of track sections 26–29. Switch assembly 50 is mounted to the ceiling support structure and, as described further below, is designed to cooperate with diverter element mounted on the panel trolleys to direct panels being moved along track section 26 in a wall-forming direction into one of track sections 27, 28 and 29. Another switch assembly, generally designated 60, serves as the intersection of track sections 29–32 to which it is operably connected. Switch assembly 60 also is mounted to the ceiling support structure and is designed to cooperate with diverter elements mounted on the panel trolleys to direct panels being moved along track section 29 in a wall-forming direction into one of track sections 30, 31 and 32.

The stacking of panels 22 within housing 24 is achieved through the use of switch assemblies 70 and 80 that are interconnected by track segment 72 and which are mounted to the ceiling support structure. Switch assembly 70 is operably connected to track section 26, as well as to panel stacking track segments 73 and 74 mounted to the ceiling support structure by hanger brackets 44. Switch assembly 80 is connected to panel stacking track segments 75 and 76 mounted to the ceiling support structure by hanger brackets 44.

Panels 22 are stacked along track segments 73–76 when stored within housing 24. The length of track segments 73–76 is a function of the number of panels to be stacked, which in turn is a function of the length of the walls formed by the panels when moved to their wall-forming positions. In FIG. 3, only six panels are shown to facilitate illustration, and these panels are designated as 22*a*, 22*b*, 22*c*, 22*d*, 22*e* and 22*f*. Each of these panels represent multiple panels of a similar type, with the types being distinguished herein based solely on the configuration of their trolleys. Specifically, and while the panels may otherwise be similar in most respects, as described below the trolleys of panel type 22*a* differ from the trolleys of panel type 22*b*–*f*, which in turn have trolleys that differ from each other. When the operable wall is fully extended, panels of the type 22*a* are aligned along the entire length of track section 30, panels of the type 22*b* are aligned along the entire length of track section 31, panels of the type 22*c* are aligned along the entire length of track section 27, panels of the type 22*d* are aligned along the entire length of track section 28, and panels of the type 22*e* and 22*f* are aligned along the entire length of track sections 26, 29 and 32. Naturally, the number of panels each of panels 22*a*, 22*b*, 22*c*, 22*c*, 22*e* and 22*f* represents can differ as it is dependent upon the length of the walls being formed, and it is not material to the present invention.

Each of panels 22 is suspended from the track system by two trolleys, namely a lead trolley and a trailing trolley, positioned proximate opposite ends of that panel. As used herein, lead and trailing are referenced with respect to the trolley position during movement of the panels from a stacked position to a wall-forming position. The lead or front trolleys of panels 22*a*, 22*b*, 22*c*, 22*d*, 22*e* and 22*f*, when such panels are stacked, are disposed along track segments 73 and 74, and the trailing or back trolleys of the panels when stacked are disposed along track segment 75 and 76. For example, and with reference to stacked panel 22*e*, a lead trolley generally represented at 82 suspends the panel from track section 73, and a trailing trolley generally represented at 83 suspends the panel from track section 75.

The automatic track switching system of the present invention employs switch or diverter elements mounted to the trolleys of panel 22. The overall form of the trolleys to which such diverter elements are attached may be selected from one of the many known designs. As a result, the term trolley is used generally herein, and is intended to encompass devices, including wheeled carriage and carriers, of all types that are operably connected to and movable along various tracks.

The trolleys used with panel types 22*a* through 22*f* differ only in the configuration of their diverter elements. Each lead and trailing trolley includes a side diverter element. The diverter blades on the side diverter elements are located at one of three different lateral positions relative to and on each side of the trolley center line. In addition to the side diverter elements, each trailing trolley and only the trailing trolleys also includes a center diverter element. Center diverter elements are not used on the lead trolleys.

In the description that follows only the trolleys for use with panel types 22*a*, 22*c*, and 22*e* will be described. Trolleys with these panels will include side diverter elements positioned to the right of the trolley centerline from the perspective of a person in FIG. 3 standing at switch 50 and looking to the left toward housing 24. Each trolley described will have a counterpart for use with panel types 22*b*, 22*d* or 22*f* wherein the only difference is that the side diverter element is positioned to the left of the trolley centerline.

Figure 5:
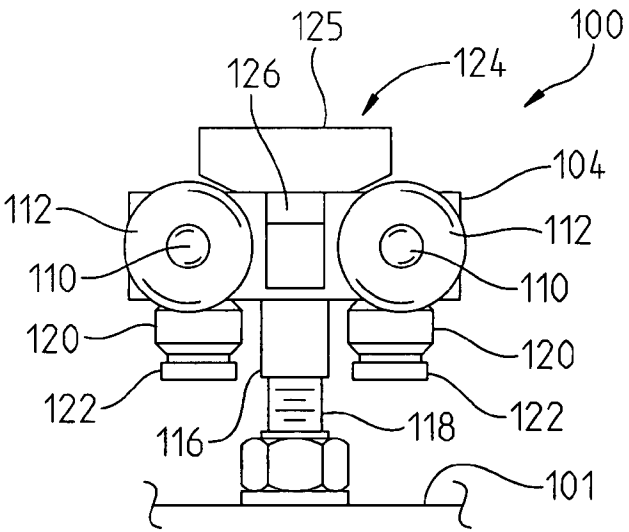
FIG. 5 is a right side view of the trolley of FIG. 4.
Figure 4:
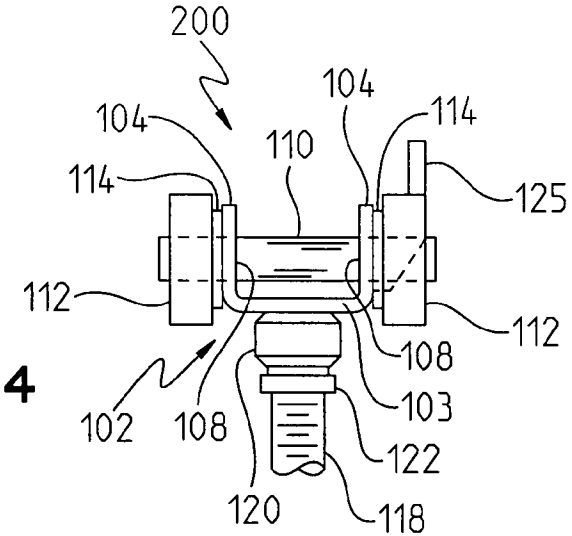
FIG. 4 is a front view of a lead trolley equipped with a side diverter element in the outermost lateral position for the track switching system of the present invention.

One suitable lead trolley design for use with panel type 22*e* is shown in FIGS. 4 and 5 and is generally represented at 100. Trolley 100 includes a U-shaped carrier channel 102 having a base or web portion 103 and a pair of opposite upstanding sidewall portions 104. A pendent bolt fitting 116 downwardly extends from the lower surface from the base portion 103. The fitting 116 is internally threaded to receive a pendant trolley bolt 118 which is secured to the top section of a movable wall panel abstractly shown at 101. Sidewall portions 104 defines bores 108 through which axles 110 are received. Four trolley wheel assemblies 112 are rotatably mounted on the axles 110 extending through sidewall portions 104 and wheel spacers 114. Wheel assemblies 112 rollingly engage the various tracks for moving wall panel 101. Guide rollers 120 extend into the track slot and serve to reduce friction between the trolley 100 and the slot. Guide rollers 120 are rotatably mounted on pivot posts 122 which are attached to the channel base portion 103 by any suitable means several of which are known in the art.

The trolley 100 is equipped with a side diverter element 124 that cooperates with guide plates mounted on the inside of the upper surface of the track switch sections to route the panel through the switch. The diverter element 124 is displaced laterally or perpendicular from the trolley centerline in the direction of the motion of the trolley along the track. The diverter element 124 includes a blade portion 125 that extends above the trolley wheels 112 and a body portion 126 that fixedly attached such as by welding to the carrier sidewall portion 104 between the wheel assemblies 112.

Figure 7:
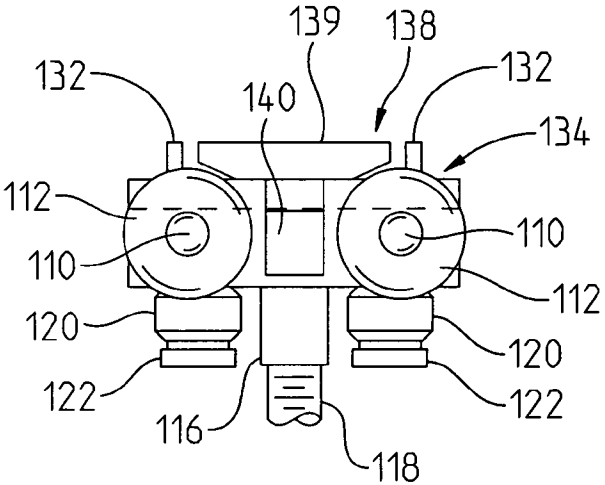
FIG. 7 is a right side view of the trolley of FIG. 6.
Figure 6:
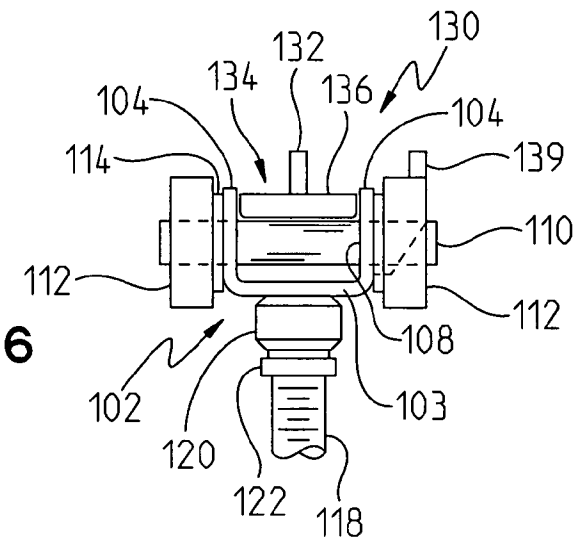
FIG. 6 is a front view of a trailing trolley equipped with a side diverter element in the outermost lateral position for the track switching system of the present invention.

With reference to FIGS. 6 and 7, there is shown is a trailing trolley 130 that could be paired with trolley 100 of FIGS. 4 and 5 for use on panel type 22*e*. The trolley 130 includes a center diverter element 134 in the form of a pair of pins 132 projecting vertically upward from a base plate 136 that is fixedly attached to the upper portion of carrier side walls 104. Rather than the pin shown, a diverter element in the form of a rigid plate or blade may be used on the center diverter 134. The trailing trolley 130 also includes a side diverter element 138 having a diverter blade 139 at the same lateral displacement from the trolley centerline as diverter blade 125 on trolley 100. Side diverter element 138 also includes a body portion 140 which is fixedly attached to carrier sidewall portion 104. Diverter blade 139 of trolley 130 is shorter in length than diverter blade 125 of lead trolley 100. Based on these differences in diverter blade length along with the presence of a center diverter 132 on trailing trolley 130, the lead and trailing trolleys 100 and 130 respectively can be routed differently through a given switch section.

Figure 9:
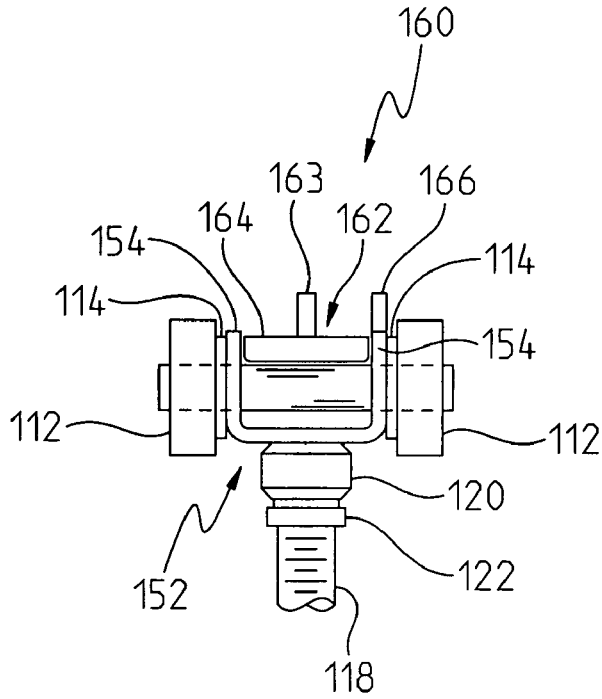
FIG. 9 is a front view of a trailing trolley equipped with a side diverter element in an intermediate lateral position for the track switching system of the present invention.
Figure 8:
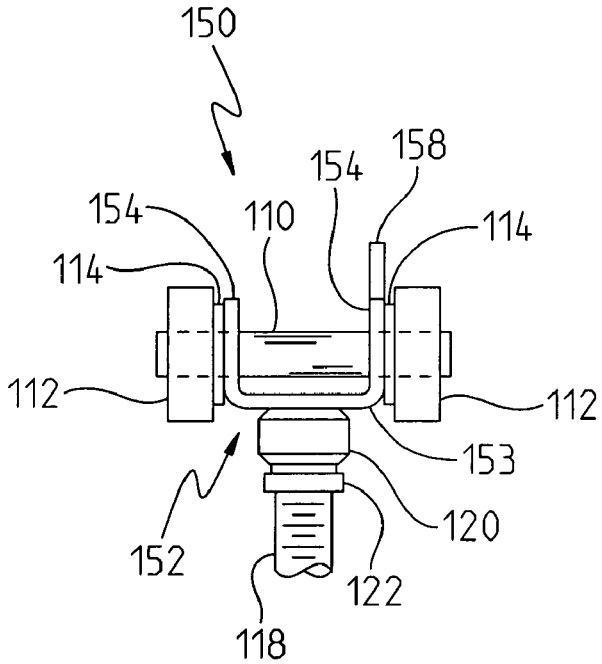
FIG. 8 is a front view of a lead trolley equipped with a side diverter element in an intermediate lateral position for the track switching system of the present invention.

FIGS. 8 and 9 show lead and trailing trolleys that can be used on panel type 22*c*. Lead trolley 150 in FIG. 8 includes a U-shaped carrier channel 152 having a base or web portion 153 and upstanding sidewalls 154. A side diverter element in the form of a diverter blade 158 extends vertically upward from carrier channels sidewall 154. The diverter blade 158 may be fixedly attached to sidewall portion 154, such as by welding. Alternatively, the diverter blade may be integrally formed with channel sidewall 154. As with the previous trolleys, diverter blade 158 functions to engage complimentary guide plates provided on the track switch section. As a lead trolley, trolley 150 includes no center diverter.

In FIG. 9, trailing trolley 160 for panel type 22*c* is shown. As a trailing trolley, trolley 160 includes a center diverter element 162 which includes a pair of diverter pins 163 extending vertically upward from a base plate 164 that is fixedly attached such as by welding to carrier channel sidewall portions 154. A side diverter blade 166 extends vertically upward from carrier sidewall portion 154 as shown. As in the previously described lead and trailing trolley pair, side diverter blade 166 of trailing trolley 160 is shorter in height than diverter blade 158 of lead trolley 150.

Figure 10:
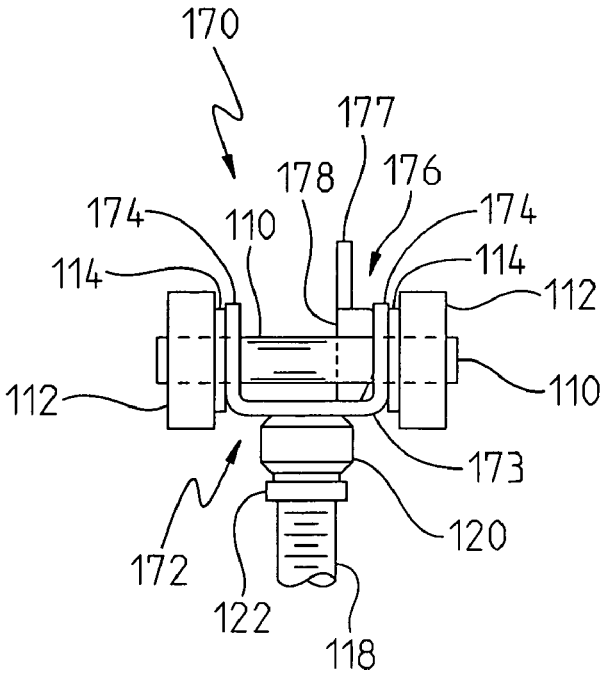
FIG. 10 is a front view of a lead trolley equipped with a side diverter element in the innermost lateral position for the track switching system of the present invention.

With reference now to FIG. 10, there is shown a lead trolley 170 for use with panel type 22*a*. Trolley 170 includes a U-shaped carrier channel 172 having a base or web portion 173 and upstanding sidewall portions 174. Trolley 170 includes a side diverter element 176 positioned inwardly from carrier sidewall portion 174. Diverter element 176 includes a body portion 178 that is preferably fixedly attached such as by welding to the inside of sidewall 174 between axle pairs 110. Diverter blade 177 extends vertically upward from the body portion 178.

Figure 11:
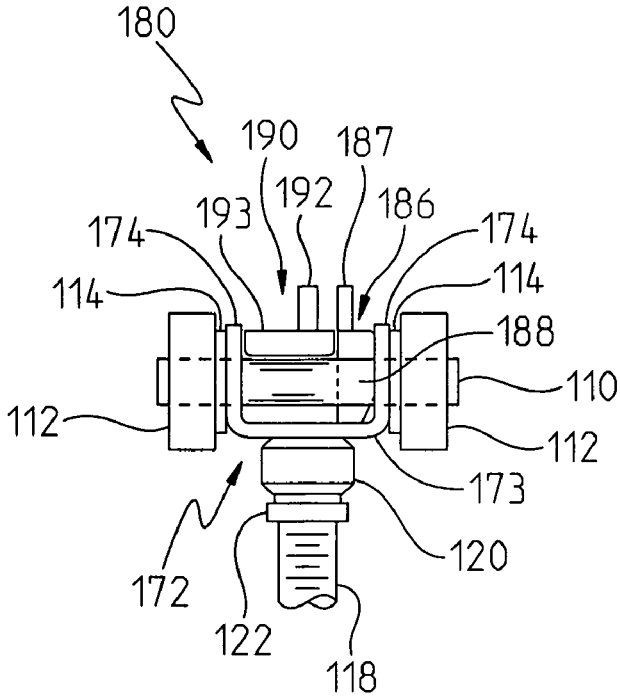
FIG. 11 is a front view of a trailing trolley equipped with a side diverter element in the innermost lateral position for the track switching system of the present invention.

A trailing trolley suitable for use with panel type 22*a* is generally represented at 180 in FIG. 11. Similar to lead trolley 170, trailing trolley 180 includes a side diverter element 186 that includes a body portion 188 fixedly attached to the inside of sidewall 174 and having a vertically extending diverter blade 187 which is shorter in height that diverter blade 177 of the lead trolley 170. As a trailing trolley, trolley 180 includes a center diverter element 190 that includes a pair of diverter pins 192 that extend vertically upward from a base plate 193. Base plate 193 is fixedly attached at one side to body portion 188 of side diverter element 186. The other side of base plate 193 is fixedly attached to the opposite carrier channel side wall 174. Side diverter blades 177 and 187 of trolleys 170 and 180 respectively represent the most laterally inward of the side diverter blade positions.

Figure 12:
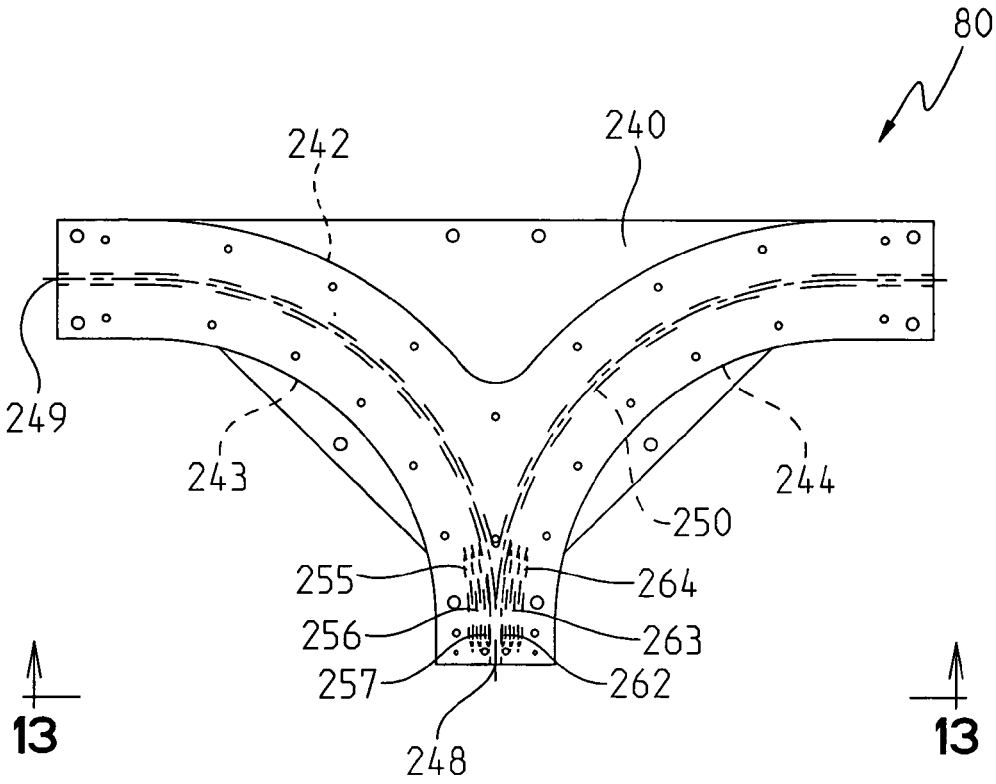
FIG. 12 is a top view of a switch assembly from FIG. 2, shown removed from the remainder of the track, which serves to direct trailing trolleys to their proper track sections during wall panel stacking.
Figure 13:
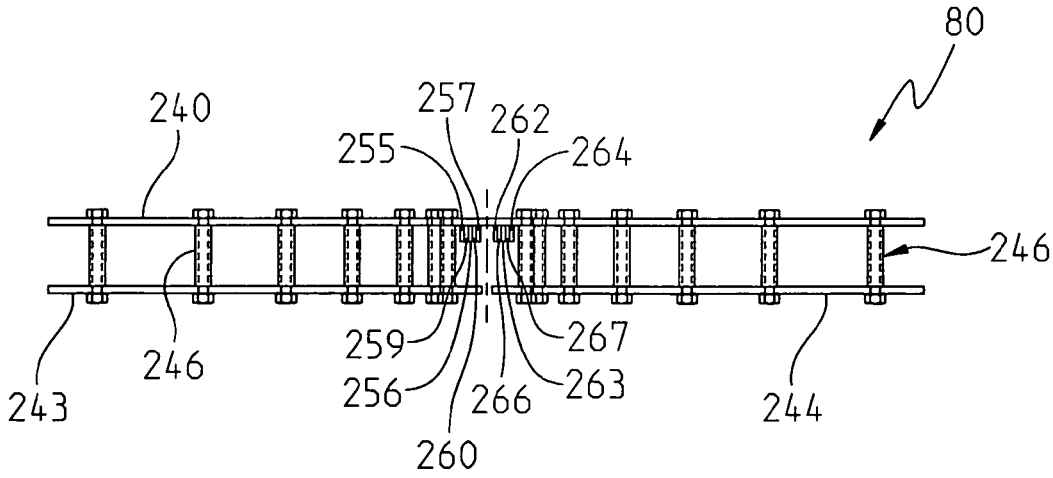
FIG. 13 is a front view, taken along line 13—13 in FIG. 12, of the switch assembly of FIG. 12.

The switch assemblies particularly designed for use in conjunction with the panel suspending trolleys of FIGS. 4–11 are shown in greater detail in FIGS. 12–25. With reference now to FIGS. 12 and 13, the switch assembly 80 that during wall stacking cooperates with the trolley diverter elements to route the trailing trolleys to their proper track sections is shown in top view and front view, respectively. In the illustrated embodiment, switch assembly 80 is formed from a single top plate 240 and three bottom plate sections 242, 243 and 244. Top plate 240 is suspended from a support structure with conventional fasteners in order to mount switch assembly 80 in the ceiling of room 20. Plate sections 242–244 are each connected to top plate 240 in a vertical spaced-apart relationship in a well-known manner with a plurality of bolt and nut type fasteners that extend through tubular steel spacers 246 sandwiched between the various switch plates. The portions of these plate-connecting fastener assemblies that lie above the upper surface of top plate 240 are not shown in FIG. 12 for purposes of illustration.

Plate sections 243 and 244 are horizontally spaced apart to provide a track path 248 into which enter trolleys being routed into switch assembly 80 in a panel stacking direction. Plate sections 242 and 243, and plate sections 244 and 242, are horizontally spaced apart to provide arcuate track paths or slots 249 and 250, respectively. Track paths 248, 249 and 250, which provide the spaces through which extend the pendant bolts of the trolleys when the trolleys move or roll along the upper surface of plate sections 242–244, are aligned with the track paths of track sections 72, 76 and 75, respectively.

Diverters or guides used to selectively route trolleys passing along track path 248 into either track path 249 or 250 include a series of elongate plates mounted on either side of track path 248. As shown in FIG. 12, three elongate and arcuate guide plates 255,256 and 257 are fixedly attached, such as by welding to: the underside of the top plate 240 proximate and left of track path 248. Guide plates 255–257 are evenly horizontally spaced to provide channels 259 and 260. Three elongate, arcuate guide plates 262, 263 and 264 are similarly attached to the underside of top plate section 240 right of track path 248 to provide channels 266 and 267. The ends of the guide plates are pointed to aid in routing diverter blades into the appropriate channel or space as described further below.

Referring to FIG. 13, in conjunction with the height of the diverter blades of the side diverters of the trolleys, each of guide plates 255–257 and 262–264 are made sufficiently tall so as to project down from the top plate to a height at least slightly below the tops of the upstanding blades of the side diverter elements of the trailing trolleys. As so configured, the diverter blades must either enter one of the channels 259,260, 266 and 267, or enter the spaces laterally outward of guide plates 255 and 264, when the trolleys pass along track path 248. Specifically, when the trailing trolleys shown in FIGS. 6, 9, and 11 are separately routed through track path 248 in a wall-stacking direction, diverter blade 139 passes along the outer side of guide plate 264, diverter blade 166 moves within channel 267, and diverter blade 187 moves within channel 266, thereby routing these trolleys into track path 250.

Although guide plates 255–257 and 262–264 are shown as having the same height, guide plates 255–257 and 262–264 could all be of different heights, so long as each plate is sufficiently tall so as to engage the appropriate trolley diverter blades during use.

Figure 14:
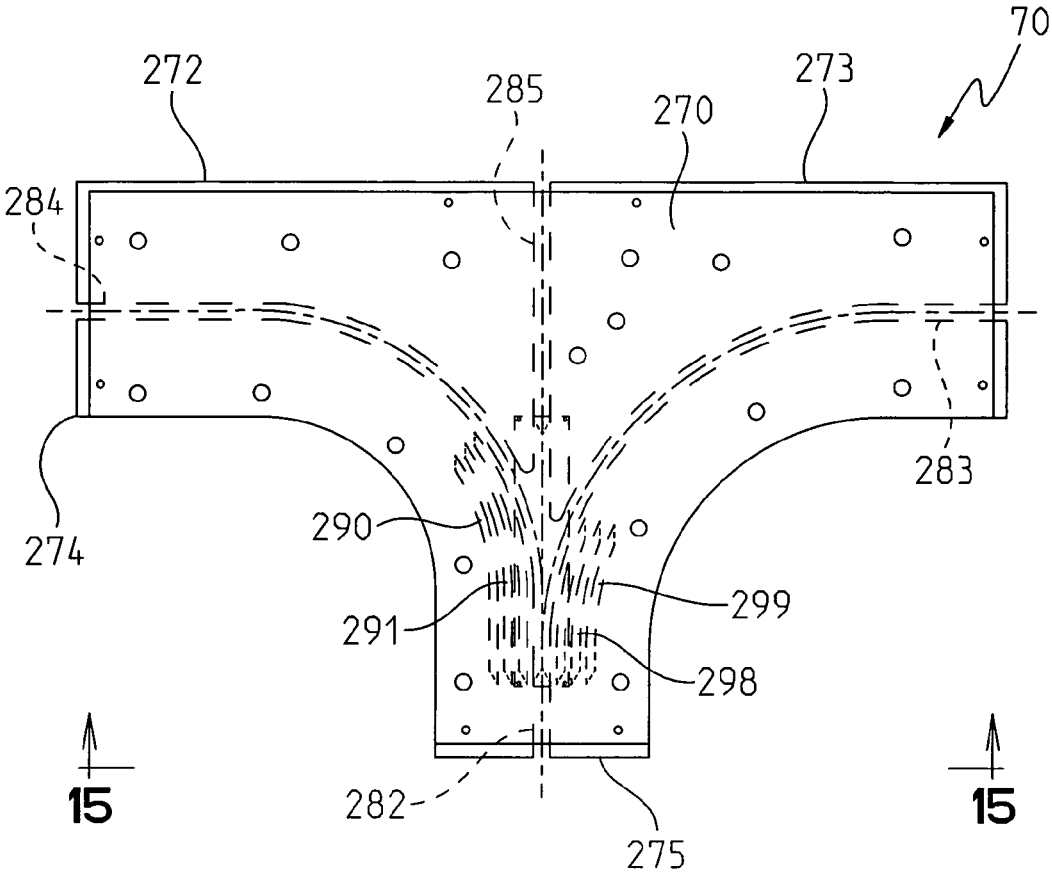
FIG. 14 is a top view of a switch assembly from FIG. 2, shown removed from the remainder of the track, which serves to direct lead trolleys to their proper track sections during wall panel stacking.
Figure 15:
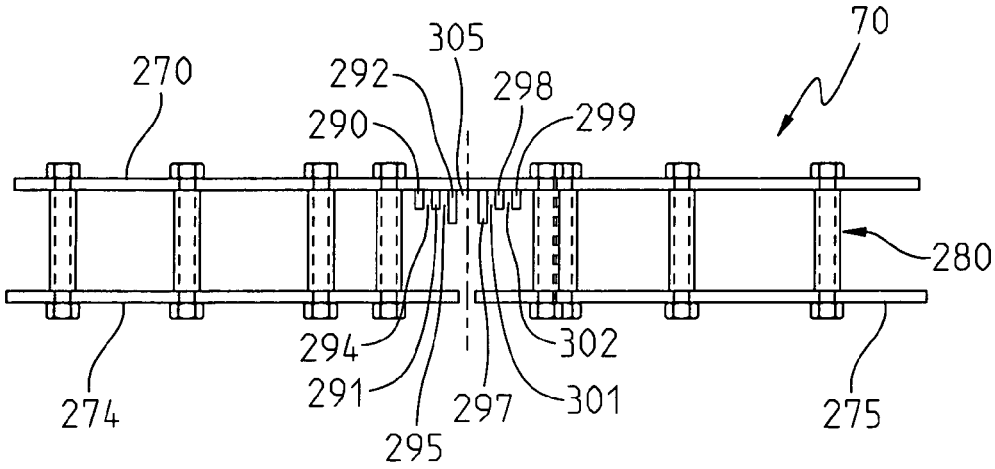
FIG. 15 is a front view, taken along line 15—15 in FIG. 14, of the switch assembly of FIG. 14.
Figure 17:
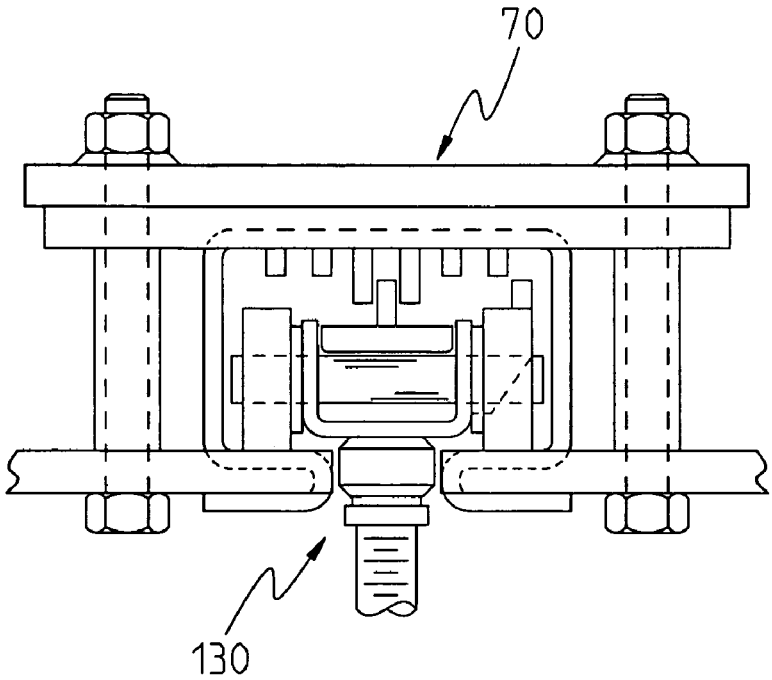
FIGS. 16–21 are front views showing the lead and trailing trolleys of FIGS. 4–11 entering the switch assembly of FIG. 15.

With reference now to FIGS. 14 and 15, the switch assembly 70 that during wall stacking cooperates with the trolley diverter elements to route the lead and trailing trolleys to their proper track sections is shown in top view and front view, respectively. In the illustrated embodiment, switch assembly 70 is formed from a single top plate 270, mounted in the room ceiling, and four bottom plate sections 272, 273, 274 and 275. Bottom plate sections 272–275 are each connected to top plate 270 in a vertical spaced-apart relationship via spacing fasteners indicated at 280.

Bottom plate sections 274 and 275 are horizontally spaced apart to provide a track path 282 into which enter trolleys being routed in a panel stacking direction. Plate sections 273 and 275, and plate sections 272 and 274, are horizontally spaced apart to provide arcuate track paths 283 and 284, respectively, in communication with track path 282. Plate sections 272 and 273 are horizontally spaced apart to provide a linear track path 285 in communication and aligned with track path 282. Track paths 282, 283, 284 and 285 are aligned with the track paths of track sections 26, 73, 74 and 72, respectively.

In order to maintain the downstream ends of track paths 283 and 284 in alignment with each other while at the same time, having the upstream ends of these track paths be staggered along the track path 282 to avoid relatively large gaps between the bottom plates, arcuate paths 283 and 284 are formed with different radiuses. One suitable radius for the tighter turn for the trolley is about eight inches, while a suitable radius for the more gentle turn can be about twelve inches. Other radiuses of curvature for either turn of the illustrated switch assembly, such as 16, or 20, or 24 inches and preferably greater than eight inches, may be employed. Different trolleys may allow use of still different radiuses of curvature, including larger and smaller radii.

Guides used to selectively route lead trolleys passing along track path 282 into either track path 283 or 284 include a series of plates mounted to the underside of top plate 270 on either side of track path 282. Arcuate guide plates 290, 291, and straight guide plate 292 are fixedly attached to the underside of top plate section 270 left of track path 282 to form channels 294 and 295. Two arcuate guide plates 298 and 299 and straight guide plate 297 are similarly attached to the underside of top plate 270 right of track path 282 to provide channels 301 and 302. Each of guide plates 290–291 and 298–299 is shorter than guide plates 255–257 and 262–264 of switch assembly 80. Specifically, guide plates 290–291 and 298–299 are made sufficiently tall so as to project down to a height slightly below the tops of the upstanding blades of the side diverter elements of the lead trolleys, but not so tall as to extend below the tops of the shorter blades of the side diverter elements of the trailing trolleys. As a result, during operable wall stacking when the trolleys are passed through track path 282, while the diverter pins of the trailing trolleys do not engage guide plates 290–291 and 298–299 so that these guide plates do not interfere with the motion of the trailing trolleys, the diverter blades of the lead trolleys are guided by these plates. Diverter blade 125 passes along the outer side of guide plate 299, diverter blade 158 moves within channel 302, and diverter blade 177 moves within channel 301, thereby routing the trolleys of FIGS. 4, 8, and 10 into track path 283.

In order to ensure the trailing trolleys, being moved in a stacking direction through track path 282 continue into track path 285 and not track paths 283 and 284, straight guide plates 292 and 297 define a channel 305 into which the center diverter of each of the trailing trolleys of FIGS. 6, 9, and 11 upwardly extends.

Figure 16:
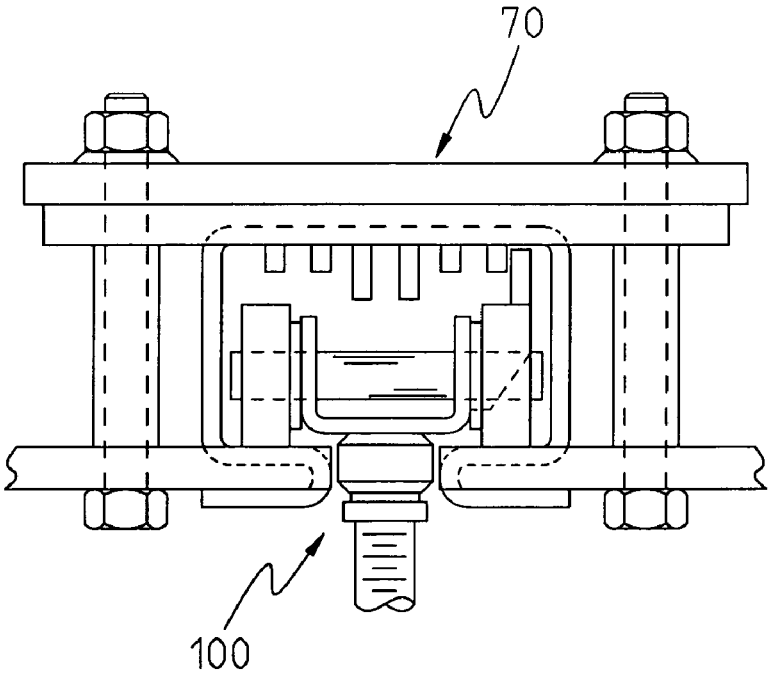
Figure 19:
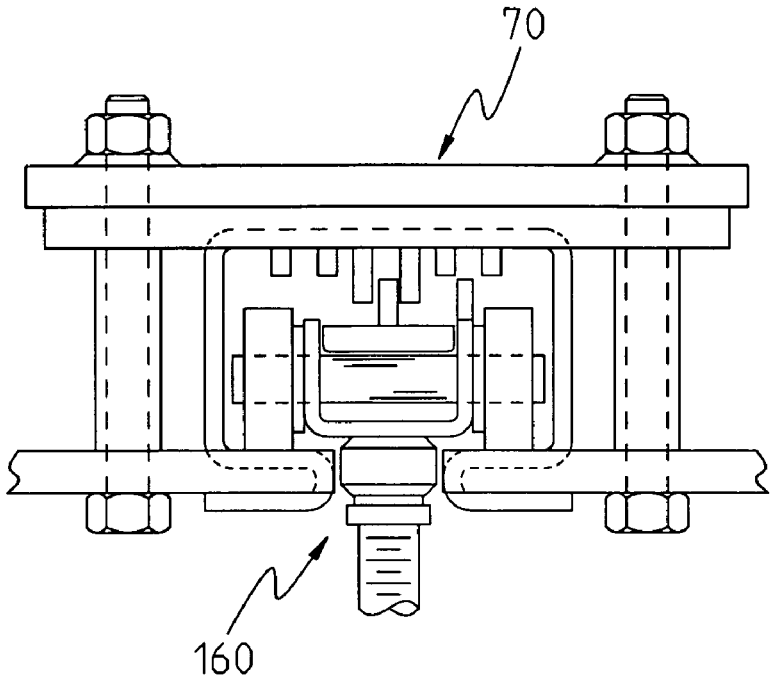
Figure 18:
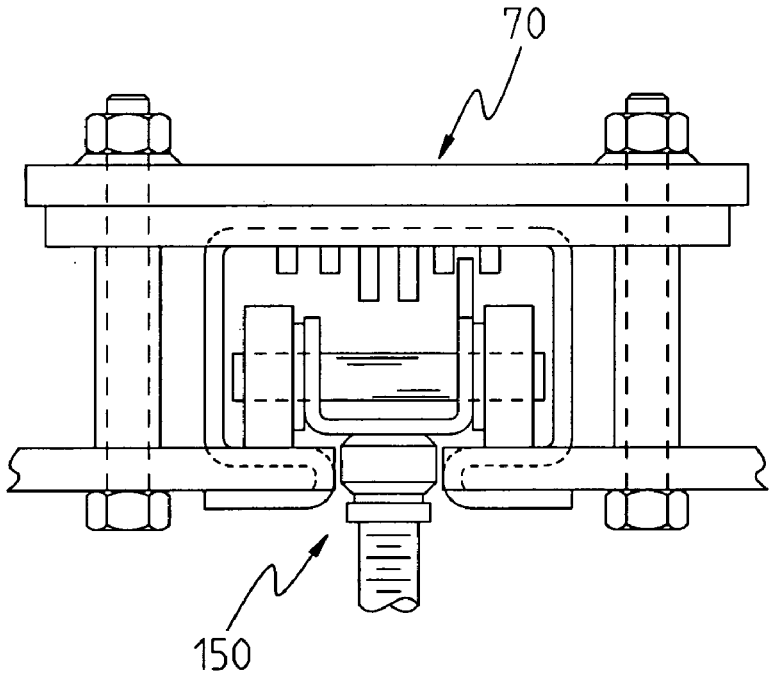
Figure 21:
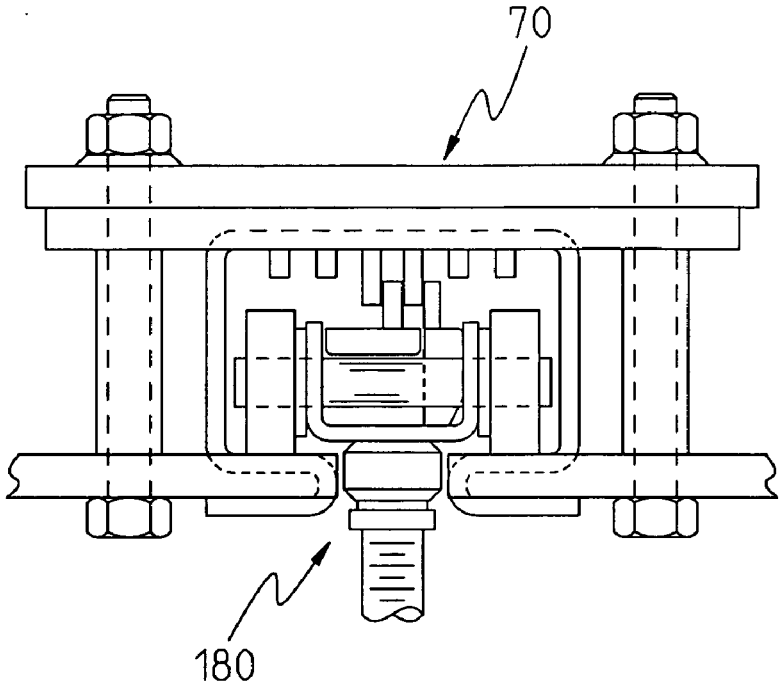
Figure 20:
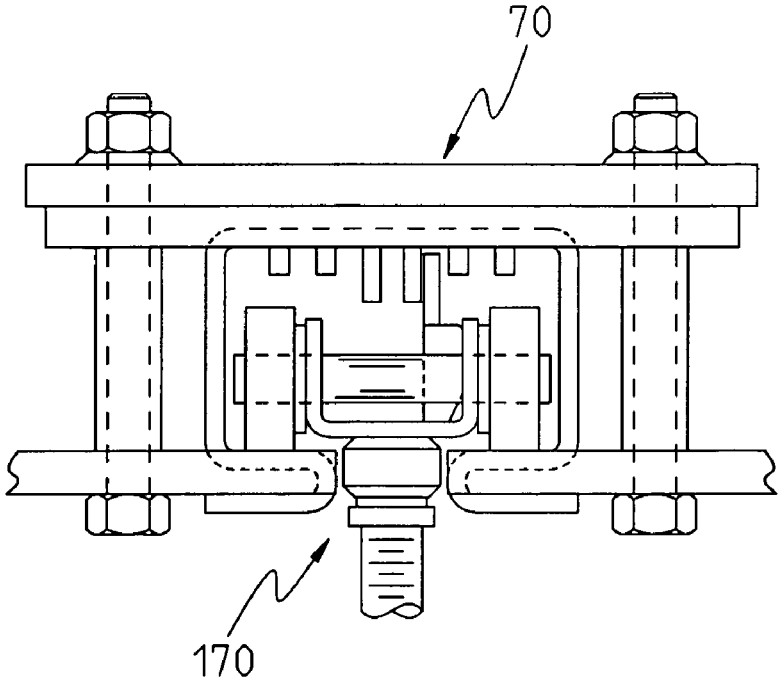

Lead trolleys 100, 150, and 170 are depicted entering switch assembly 70 in FIGS. 16, 18, and 20 respectively. The side diverter blades of these trolleys operatively engage guide plates 297–299. Trailing trolleys 130, 160, and 180 are depicted entering switch assembly 70 in FIGS. 17, 19, and 21 respectively. With these trolleys, only the center diverter operatively engages guide plates 292 and 297.

Figure 22:
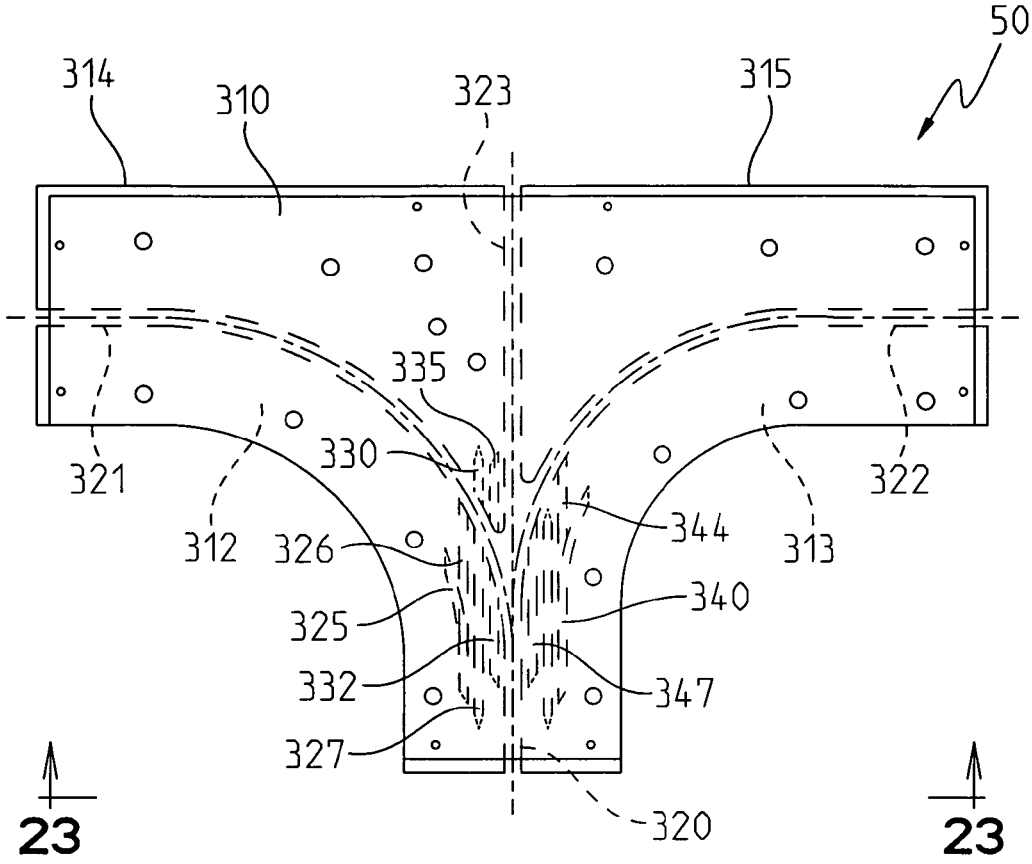
FIG. 22 is a top view of a first switch assembly from FIG. 2, shown removed from the remainder of the track, which serves to direct trolleys to the proper intersecting track sections during movement of the suspended panels in a wall forming direction.
Figure 23:
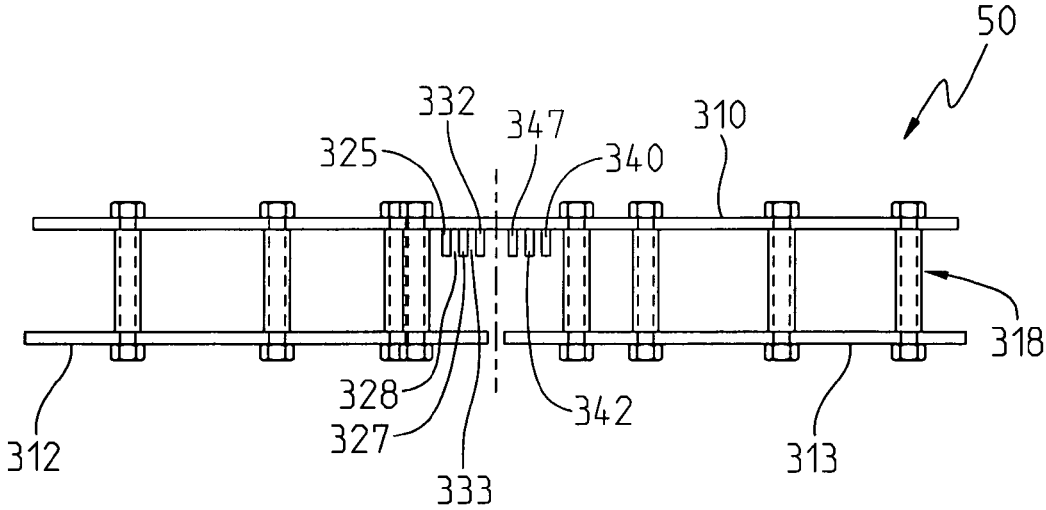
FIG. 23 is a rear view, taken along line 23—23 in FIG. 22 of the switch assembly of FIG. 22.

With reference now to FIGS. 22 and 23, the switch assembly 50 that during wall extension cooperates with the upstanding blades of the side diverter elements of the trolleys to route the trolleys to their proper track sections is shown in top view and rear view, respectively. Switch assembly 50 is formed from a single top plate 310, mounted in the room ceiling, and four bottom plate sections 312, 313, 314 and 315. Bottom plate sections 312–315 are each connected to top plate 310 in a vertical spaced-apart relationship by spacing fasteners indicated generally at 318.

Bottom plate sections 312 and 313 are horizontally spaced apart to provide a track path 320 into which enter trolleys being moved into switch assembly 50 along track section 26 in a forward or wall extending direction. Plate sections 312 and 314, and plate sections 313 and 315, are horizontally spaced apart to provide track paths 321 and 322, respectively, that are in communication with track path 320 and that have different radiuses of curvature similar to the track paths of switch 70. Plate sections 314 and 315 are horizontally spaced apart to provide a linear track path 323 in communication and aligned with track path 320. Track paths 321, 322 and 323 feed the trolleys moving therealong into the track paths of track sections 27, 28 and 29, respectively.

Guides used to selectively route trolleys passing along track path 320 into one of track path 321, 322 or 323 include an arrangement of guide plates fixedly mounted to the underside of top plate 310. In order to ensure engagement with the upstanding diverter blades of both. the lead trolleys and the trailing trolleys, each guide plate on switch assembly 50 is sufficiently tall so as to project down from the top plate to which it is attached to a height slightly below the tops of the shorter upstanding blades of the side diverter elements of the trailing trolleys. Plates of this standard height also naturally project below the tops of taller, upstanding blades of the side diverter elements of the lead trolleys.

Guide plate 325 serves to route trolleys moving along track path 320 into track path 321 in the process of forming a wall along track segment 27. Arcuate guide plate 325 is structured such that diverter blade 125 of trolley 100, and diverter blade 139 of trolley 130 slide along the laterally outer face of guide plate 325 to route trolleys 100 and 130 into track path 321. Straight guide plates 326 and 327 define a channel 328 through which slide diverter. blade 158 of trolley 150 and diverter blade 166 of trolley 160. Guide plates 326 and 327 are structured to prevent trolleys 150 and 160 from entering track path 321 as the trolleys move forward in a wall extending direction along track path 320. Guide plate 330, which is aligned with guide plate 327, functions to prevent trolleys 150 and 160 from straying into track path 322, and thereby direct such trolleys into track path 323 by the engagement of diverter blades 158 and 166 against the laterally outward face of guide plate 330. Straight guide plate 332 and, guide plate 327 together define a channel 333 through which slide diverter blade 177 of trolley 170 and diverter blade 187 of trolley 180. Guide plates 327 and 332 prevent trolleys 170 and 180 from entering track path 321 as the trolleys move forward in a wall extending direction along track path 320. Guide plate 335 is aligned with guide plate 332 and functions to prevent trolleys 170 and 180 from straying into track path 322, and thereby direct such trolleys into track path 323, by the engagement of diverter blades 177 and 187 against the laterally outward face of guide plate 335. In a similar fashion, guide plates 340, 342, 344, and 347 restrict access to track path 322 and track section 28.

Figure 24:
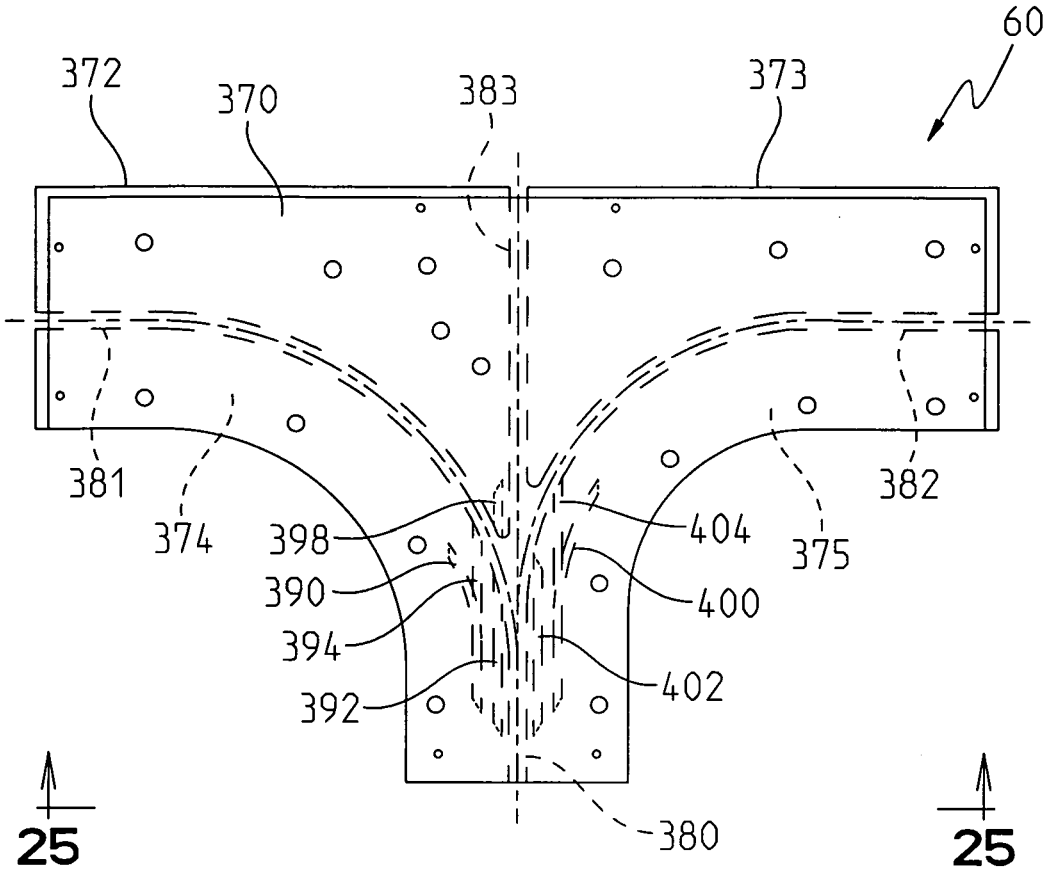
FIG. 24 is a top view of another switch assembly from FIG. 2, shown removed from the remainder of the track, which serves to direct trolleys to the proper intersecting track sections during movement of the suspended panels in a wall forming direction.
Figure 25:
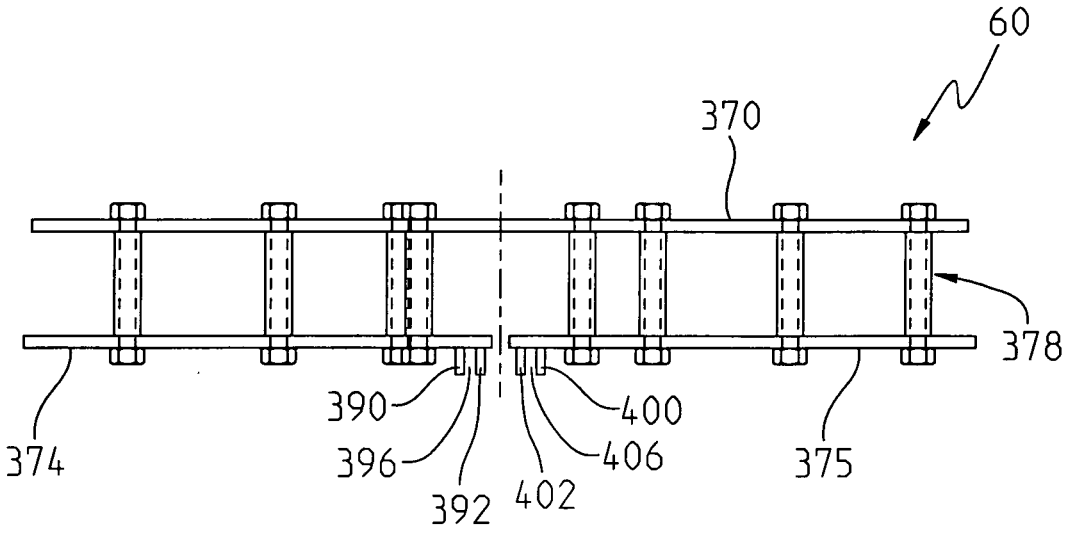
FIG. 25 is a rear view, taken along line 25—25 in FIG. 24 of the switch assembly of FIG. 24.

With reference now to FIGS. 24 and 25, the switch assembly 60 that during wall extension cooperates with the upstanding blades of the side diverter elements of the trolleys to route the trolleys to their proper track sections 30–32 is shown in top view and rearview, respectively. Except for its guide plate design, switch assembly 60 is constructed and mounted in a similar fashion to switch assembly 50 and includes top plate 370, bottom plate sections 372, 373, 374 and 375, and spacing fasteners 378.

Bottom plate sections 374 and 375 are spaced to provide track path 380. Plate sections 372 and 374, and plate sections 373 and 375, are horizontally spaced apart to provide track paths 381 and 382, respectively, with radiuses of curvature similar to the track paths of switch 50. Plate sections 372 and 373 are spaced to provide a linear track path 383 in line with track path 380. Track paths 380, 381, 382 and 383 are aligned with the track paths of track sections 29, 30, 31 and 32, respectively.

Guides used to selectively route trolleys passing along track path 380 into one of track path 381, 382 or 383 include guide plates fixedly mounted to the underside of top plate 370. The guide plates, although shown in FIG. 25 as having uniform heights, may be of different heights as long as each is sufficiently tall to engage the upstanding diverter blades of both the passing lead trolleys and the trailing trolleys. Arcuate guide plate 390 is structured such that diverter blade 158 of trolley 150, and diverter blade 166 of trolley 160, slide along the laterally outer face of guide plate 390 to route trolleys 150 and 160 moving along track path 380 into track path 381 in the process of forming a wall along track segment 30. Straight guide plates 392 and 394, together with a segment of guide plate 390, define a channel 396 through which slides diverter blade 177 of trolley 170 and diverter blade 187 of trolley 180. Guide plates 392 and 394 prevent trolleys 170 and 180 from entering track path 381 as the trolleys move forward in a wall extending direction along track path 380. Guide plate 398 is aligned with guide plate 392 and functions to prevent trolleys 170 and 180 from straying into track path 382, and thereby directs such trolleys into track path 383, by the engagement of diverter blades 192 and 186 against the laterally outward face of guide plate 398. In a similar fashion, guide plates 400, 402, and 404 restrict access to track path 382 and track section 31.

The automatic track switching system of the present invention will be further understood in view of the following description of its operation. When the panels are in the stacked arrangement shown in FIG. 2, to compartmentalize room 20 the panels are first removed from housing 24 manually by a user who subsequently pushes or pulls the panel along the various track sections to a wall-forming position. In particular, when a panel of the type 22*a* is moved from its stacked arrangement, the engagement of its trolleys with the switch assemblies 70 and 80 causes panel 22*a* to be routed into track section 26. Upon reaching switch assembly 50, the above-described engagement of the guide plates mounted on the switch assembly with the upstanding blades of the side diverter elements of its trolleys cause panel 22*a* to pass through switch assembly 50 into track segment 29. When panel 22*a* reaches switch assembly 60, the engagement of the guide plates of the switch assembly with the upstanding blades of the side diverter elements of the trolleys automatically switches panel 22*a* into the track path which leads to track section 30.

Panels of the type 22*c* are routed via switch assemblies 70 and 80 into track section 26, and are automatically routed by switch assembly 50 into track section 27. Panels of the type 22*e* are routed by switch assemblies 70 and 80 into track section 26, and, depending on the order in which they are moved from housing 24, such panels are aligned along track, segments 32, 29 and 26.

The process of moving the panels back to a stacked arrangement is performed in generally the reverse order of the wall-forming process. As the panels traveling along track section 26 are moved rearward, the trailing trolleys enter the switch assembly 70. Because the shorter upstanding pins of the side diverter elements of the trailing trolleys do not vertically extend upward to engage the guide plates of assembly 70, the trailing trolleys are not affected by such guide plates. However, the center diverter disposed at the top of each trailing trolley engages the innermost guides 292 and 297, thereby routing the trailing trolleys into track segment 72 and then ultimately to switch assembly 80. As the panels continue to move rearward, the guide plates of switch assembly 80 engage the upstanding pins of the side diverter elements of the trailing trolleys to route the trailing trolleys into the proper track section for stacking, and the guide plates of switch assembly 70 engage the upstanding pins of the side diverter elements of the lead trolleys to route the lead trolleys into the proper track section for stacking.

By utilizing diverter elements on the trolleys which are provided at different lateral spacings relative to the trolleys; it is possible to provide automatic track switching systems adaptable for use with a great variety of types of wall arrangements. Although trolleys with side diverter elements with three lateral pin positionings are shown, systems with fewer or possibly even greater lateral positionings are within the scope of the present invention.

While this invention has been shown and described as having multiple designs, the present invention may be further modified within the spirit an scope of this disclosure. For instance, although the lead and trailing trolley pairs have been described as having side diverter elements at the same lateral positioning, the invention contemplates combinations of lead and trailing trolley pairs wherein the side diverters are positioned at different lateral displacements from the trolley centerlines.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. A multi-program track and trolley apparatus for a movable wall system having multiple wall panels supported by and movable along multiple paths defined by multiple track sections to predetermined configurations, the apparatus comprising:

a plurality of track sections;

a switch assembly at a junction between at least three of said plurality of track sections, said switch assembly defining a first path along one track section and at least second and third paths along at least two other track sections branching from said first path, said switch assembly including an upper plate portion;

at least one guide member mounted on said switch assembly along said first path, said guide member being laterally offset relative to said first path; and at least two trolleys attached to and supporting each of the wall panels of the movable wall system, each of said trolleys including a trolley body, said trolley body having upstanding sidewall portions, each of said trolleys including a pair of wheel assemblies rotatably mounted to said trolley body for rolling engagement with said track sections and a wall panel connecting element downwardly extending from said trolley body, said connecting element being configured to connect said trolley to one of the wall panels, each of said at least two trolleys having a side diverter element for selectively engaging said at least one guide member as each of said trolleys travels along said first path to route the supported wall panel along either said second or said third paths, said side diverter element positioned on said trolley at a point laterally displaced from a center axis of said trolley, wherein said center axis extends in the direction of the movement of said trolley, with at least one of said at least two trolleys having a center diverter positioned at a center point on said center axis, and said center diverter selectively engaging said at least one guide member, wherein said side diverter and said center diverter extend upwardly from said trolley body and engages said at least one guide member.

2. The track and trolley apparatus of claim 1 wherein each of said at least one guide member includes at least one guide plate downwardly extending from said upper plate portion.

3. The track and trolley apparatus of claim 2 wherein said side diverter element includes a blade portion disposed above said wheel assemblies.

4. The track and trolley apparatus of claim 3 wherein said at least one guide member is a plurality of guide members, each of said plurality of guide members being laterally offset relative to said first path at different lateral distances relative to each other.

5. The track and trolley apparatus of claim 3, wherein:

said at least two trolleys includes a lead trolley and a trailing trolley and said blade portion of said side diverter on one of said lead or trailing trolleys is taller than said blade portion of said side diverter on the other of said lead or trailing trolleys; and said guide plate has a height sized to be engaged only by the taller of said blades.

6. The track and trolley apparatus of claim 3, wherein:

said guide plate is disposed a first lateral distance from said first path; and said at least two trolleys includes a lead trolley and a trailing trolley and said diverter blade on one of said lead or trailing trolleys is disposed at said first lateral distance, while said diverter blade on the other of said lead or trailing trolleys is disposed at a second lateral distance different from said first lateral distance.

7. A multi-program track and trolley apparatus for a movable wall system having multiple wall panels supported by and movable along multiple paths defined by multiple track sections to predetermined configurations, the apparatus comprising:

at least one switch assembly at a junction between track sections defining a first path along one track section and at least second and third paths along at least two other track sections branching from said first path said at least one switch assembly including an upper plate portion;

a plurality of guide members mounted on said at least one switch assembly along said first path, said guide members being laterally offset relative to said first path at different lateral distances relative to each other; and a plurality of paired trolley assemblies, each pair of said plurality of paired trolley assemblies attached to and supporting different wall panels of the movable wall system, each of said trolley assemblies including a U-shaped channel having a transverse base portion and a pair of opposite upstanding sidewall portions, said sidewall portions defining a pair of axle bores therethrough for receiving a pair of axles, each said axle including a pair of wheel assemblies rotatably mounted thereon for rolling engagement with said track sections, a connecting element downwardly extending from said base portion, said connecting element being configured to connect said trolley to one of the wall panels, and at least one side diverter element selectively engaging said at least one guide member as each of said trolleys travels along said first path to route the supported wall panel along either said second or said third paths, said side diverter element disposed on said trolley assembly at a position offset from a center axis of said trolley assembly, said center axis extending in the direction of the movement of said trolley assembly, at least one of said paired trolley assemblies having a center diverter selectively engaging one of said plurality of guide members disposed on said trolley assembly at a position on said center axis; wherein said center diverter extends upwardly from said U-shaped channel.

8. The track and trolley apparatus of claim 7, in which each of the track sections defines a channel, wherein:

each of said guide members includes a guide plate extending vertically downward from said upper plate portion of said switch assembly; and each of said at least one said diverter element includes a vertically oriented blade portion laterally offset relative to the path defined by each track section, said blade portion for different ones of said trolley assemblies being offset at different lateral distances relative to each other for engaging said guide plate of selected ones of said plurality of guide members.

9. The track and trolley apparatus of claim 8, wherein:

a first switch assembly includes at least two first guide members in which said guide plate of each of said at least two first guide members has a first height;

a second switch assembly includes at least two second guide members in which said guide plate of each of said at least two second guide members has a second height different from said first height;

said blade portion of selected ones of said trolley assemblies has a height sized to engage only said guide plate of said at least two first guide members and not said guide plate of said at least two second guide members; and said blade portion of remaining ones of said trolley assemblies has a height sized to engage said guide plate of both said at least two first guide members and said at least two second guide members.

10. An automatic track switching apparatus for a movable wall system having multiple wall panels movable along a track having multiple paths defined by multiple track sections between a predetermined stored arrangement and a predetermined wall forming arrangement, said apparatus comprising:

a switch assembly at a junction between track sections defining a first path along one track section and at least second and third paths along at least two other track sections branching from said first path, said switch assembly including an upper plate portion;

at least one guide member mounted on said upper plate portion of said switch assembly;

a lead trolley and a trailing trolley attached to each wall panel, each said trolley including a U-shaped channel having a transverse base portion and a pair of opposite upstanding sidewall portions, said sidewall portions defining a pair of axle bores therethrough for receiving a pair of axles, each said axle including a pair of wheel assemblies rotatably mounted thereon for rolling engagement with said track sections, a connecting element downwardly extending from said base portion, said connecting element being configured to connect said trolley to one of the wall panels;

a first diverter element attached to each of said lead and trailing trolley laterally displaced from a centerline of said trolley in the direction of movement along said track for selective engagement with said at least one guide member to route the wall panel through said switch assembly in a predetermined manner to and from said wall forming arrangement; and a second diverter element attached to at least one of said lead trolley and said trailing trolley, said second diverter element having an engagement member substantially coincident with said trolley centerline of said at least one of said trailing trolley and said lead trolley, said engagement member of said second diverter element selectively engaging said at least one guide member to control the movement of the wall panel when the wall panel is moved to said predetermined stored arrangement; wherein said center diverter extends upwardly from said at least one lead trolley and said trailing trolley.

11. The apparatus of claim 10 wherein said first diverter element of said lead trolley has a first height and said first diverter element of said trailing trolley has a second height different from said first height.

12. A multi-program track and trolley apparatus for a movable wall system having multiple wall panels supported by and movable along multiple paths defined by multiple track sections to predetermined configurations, the apparatus comprising:

a plurality of track sections;

a switch assembly at a junction between track sections defining a first path along one track section and at least second and third paths along at least two other track sections branching from said first path, said switch assembly including an upper plate portion;

a storage track connected to one of said track sections, said storage track including a first stacking section, a second stacking section, and a storage switch assembly, said first and second stacking sections each including at least a pair of parallel ones of said track sections; and at least two trolleys attached to and supporting each wall panel of the movable wall system, each of said trolleys including a trolley body rotatably supporting a pair of wheel assemblies for rolling engagement with said track sections, a connecting element extending from said trolley body, said connecting element being configured to connect said trolley to one of the wall panels, and a side diverter element disposed on said trolley at a position laterally offset from a centerline of said trolley, said side diverter selectively engaging said storage switch assembly so as to direct said trolley to one of said first and second stacking sections, and one of said at least two trolley having a center diverter disposed on said trolley at a position on said centerline and selectively engaging said storage switch assembly, said center diverter extending upwardly from said one of said at least two trolleys.

* * * * *